US005803593A

United States Patent [19]

Siminovitch et al.

[11] Patent Number: 5,803,593

[45] Date of Patent: Sep. 8, 1998

[54] REFLECTOR SYSTEM FOR A LIGHTING FIXTURE

[75] Inventors: Michael J. Siminovitch, El Sobrante; Erik Page, Berkeley, both of Calif.; Carl T. Gould, Medford, Oreg.

[73] Assignee: The Regents, University of California, Oakland, Calif.

[21] Appl. No.: 735,990

[22] Filed: Oct. 24, 1996

[51] Int. Cl.[6] ..... F21V 13/10

[52] U.S. Cl. ..... 362/304; 362/293; 362/346; 313/234; 315/248

[58] Field of Search ..... 313/113, 114, 313/234, 607; 315/248; 362/293, 304, 305, 346, 377

[56] References Cited

U.S. PATENT DOCUMENTS

| | | | |
|---|---|---|---|
| 1,480,904 | 1/1924 | Halvorson, Jr. | 362/305 |
| 1,864,696 | 6/1932 | Steele et al. | 362/304 |
| 1,880,399 | 10/1932 | Benjamin | 362/304 |
| 2,017,716 | 10/1935 | Halvorson | 362/304 |
| 3,835,342 | 9/1974 | Freeman | 313/114 |
| 4,635,170 | 1/1987 | Beiswenger | 362/157 |
| 4,683,525 | 7/1987 | Camm | 362/346 |
| 4,729,065 | 3/1988 | Behnemann et al. | 362/18 |
| 4,954,938 | 9/1990 | Lyons | 362/298 |
| 4,992,695 | 2/1991 | Naum | 313/113 |
| 5,006,752 | 4/1991 | Egglink et al. | 315/248 |
| 5,130,900 | 7/1992 | Mikita | 362/61 |
| 5,178,452 | 1/1993 | Scholz | 362/319 |
| 5,334,913 | 8/1994 | Ury et al. | 313/234 |
| 5,404,076 | 4/1995 | Dolan et al. | 313/572 |
| 5,452,192 | 9/1995 | Yurich | 362/346 |

FOREIGN PATENT DOCUMENTS

| | | | |
|---|---|---|---|
| 525009 | 9/1921 | France | 362/304 |
| 88962 | 4/1992 | France | 362/304 |
| 454351 | 9/1936 | United Kingdom . | |
| 498876 | 1/1939 | United Kingdom . | |

*Primary Examiner*—Alan Cariaso
*Attorney, Agent, or Firm*—Paul R. Martin; Douglas A. Chaikin

[57] ABSTRACT

Disclosed herein is a reflector system for a lighting fixture having a illumination source surrounded by an envelope. The reflector system includes a first reflector surrounding the illumination source. The reflector system also includes a second reflector which is non-contiguous with the first reflector and which surrounds the illumination source. The illumination source creates light rays which are reflected by the first and second reflectors. The first reflector directs light rays toward the center line of the fixture. However, the reflected rays despite being so reflected do not substantially intersect the envelope. The reflected light rays from the second reflector being directed so that they diverge from the center line of the fixture avoiding intersection with the semi-transparent envelope.

12 Claims, 3 Drawing Sheets

REFLECTOR SYSTEM FOR A LIGHTING FIXTURE

STATEMENT OF GOVERNMENT INTEREST

This invention was made pursuant to contract No. DE-AC03-76SF00098 between the U.S. Department of Energy and the University of California. The U.S. Government retains certain rights in this invention.

RELATED U.S. PATENT APPLICATIONS

This invention relates in subject matter to U.S. Pat. No. 5,404,076, issued on Apr. 4, 1995, the disclosure of which is incorporated herein by reference.

FIELD OF THE INVENTION

This invention relates generally to lighting systems and more particularly to reflectors which disperse light from a light source.

BACKGROUND OF THE INVENTION

Lighting is a critical element in any human endeavor, whether the activity takes place in an indoor or outdoor environment. In indoor environments, people work more efficiently and are happier when there is proper lighting. In exterior lighting environments, sufficient light is necessary just to have the activity and plays a critical factor in many situations such as parking lots or residential, or commercial streets where proper lighting dramatically increases the safety of the people involved. As can be appreciated such lighting usually comes from very high power lighting systems and therefore efficiency is extremely desirable.

Proper lighting means that there is sufficient illumination and natural color for interior and exterior conditions. Of course, in some lighting instances it may be desirable to have a tint on the color. It therefore would be desirable to have an illumination source in which the color is changeable to match the desired environment.

High power lighting fixtures have been known for many years. Such fixtures are characterized by high powered lamps, also known as a high lumen packages, typically having several thousand lumens. Typically, such lighting fixture systems include a lamp fill having an envelope. The fill contains a material which is energized by means within the fixture, e.g. a microwave power source to radiate light energy. In one such instance, the fill material comprises mercury to provide relatively inexpensive and high efficiency lighting. As discussed in Dolan et al., U.S. Pat. No. 5,404,076, which is specifically incorporated herein by reference, such a fill while efficient and desirable as a lighting source also provides a potential environmental hazard. Dolan et al. discusses and discloses an electrodeless sulfur lamp in which the light source is disclosed as sulfur or selenium. A microwave source excites the sulfur fill element causing illumination. The microwave source radiates microwave energy into an envelope surrounding the sulfur fill. The envelope retains the microwave energy and does not allow the microwave energy to pass through the envelope. By its nature, the exterior of the envelope attenuates light rays crossing it. Thus, any light ray which crosses the envelope will be attenuated, either absorbed or scattered, to a fairly high degree.

Thus, while the Dolan et al. disclosure advances the art of lighting because it discloses a light source which is environmentally acceptable and highly efficient, it does not address the problem of reflected light being attenuated by the envelope before leaving the luminaire, or, as set forth in Dolan et al., the microwave screen. Additionally, Dolan et al. does not discuss, disclose, or teach its light source being used in a system for reflected lighting.

Other reflectors have been developed for high intensity discharge (HID) lamps. Naum, U.S. Pat. No. 4,992,695, is an example of an HID lamp which discloses a reflector-based light system employing a single reflector plate to distribute light energy from a high intensity discharge lamp. Naum discloses a single reflector which is generally concave in shape. As will be evident from Applicants' FIG. 1, such a reflector would tend to have reflected light rays intersect with the envelope or microwave screen. As described above, such reflected light rays are attenuated, either absorbed or scattered, and significantly decrease the efficiency of the lighting system.

The benefits of indirect light for reading and working are becoming more evident. Such indirect light enables one to work without the usual shadows and other drawbacks of a conventional incandescent or HID lamp system. However, such a system also requires increased lumens to provide the same quantity of task lighting. In order to provide such lighting in an economic manner, a highly efficient lighting system is necessary. No currently known system yields such results in a manner as efficient as the instant invention. It is also desirable to provide a reflected lamp system which is environmentally acceptable and which allows wide spread, efficient, and even illumination of interior and exterior space.

It is unnecessary for the purposes of this invention whether the light source has electrodes, or whether it is electrodeless. It is preferable to provide a reflector system for whatever chosen light source that results in efficient and even distribution of light. While the invention will be disclosed with respect to indirect lighting systems, direct lighting systems also benefit from the results of Applicants' reflector system and its inherent efficiency. Accordingly, the Applicants herein have developed a reflector system which is believed to fulfill the long felt industry need as set forth above.

SUMMARY OF THE INVENTION

It is an object of this invention to provide a reflector system for an efficient lighting fixture.

It is another object of this invention to provide a reflector system which includes a first reflector being non-contiguous with the second reflector for efficiently providing generally even and uniform lighting.

It is another object of this invention to provide an electrodeless reflector-based lighting fixture having a first and a second reflector which are non-contiguous and which improve the absorption and scattering characteristics of presently known such lighting fixtures.

It is a further object of this invention to provide a reflector system for a lighting fixture which provides wide area illumination for minimizing the number of fixtures which are used to illuminate an interior environment and allow for the use of high lumen package lamps.

In accordance with the objects mentioned above and those that will be more fully appreciated and mentioned below, the reflector system for a lighting fixture of the present invention, comprises:

- a light source element having an envelope surrounding the light source;
- a first reflector member surrounding the light source element;

a second reflector member, non-contiguous with the first reflector member and surrounding the light source; and the light source element generating light rays creating an angle of incidence and an angle of reflection with each of the first and second reflectors and each of the reflectors being designed so that the angle of reflection substantially causes the reflected rays not to cross the envelope surrounding the light source, whereby, the reflected light rays emitted from the light source provide illumination without crossing the envelope and thereby provide illumination without being attenuated to a substantial degree.

In a preferred embodiment the reflector system for a lighting fixture in accordance with this invention includes an electrodeless light source fill. The electrodeless light source fill may be chosen from the group of elemental material, namely sulfur, selenium, or phosphorus.

In a preferred embodiment the first reflector is concave and the reflected rays are directed toward the center axis of the fixture and hit the target without the reflected rays crossing the envelope. The second reflector is sized and shaped to diverge the reflected rays from the center line of the fixture. Thus, the second reflector also directs reflected light rays for illumination without the rays intersecting the envelope. Additionally, the lenses provide additional light control.

In yet another preferred embodiment the light source, the first reflector, and the second reflector are held together by a frame. The frame includes a base for each of the reflectors and a series of rods and bolts which bound together all of the components.

In yet another preferred embodiment, the first and second reflectors each include a glass lens, such that when light is reflected for illumination, it passes through the glass lens for each of first and second reflectors. This glass lens assists in retaining microwaves within the lighting fixture should any escape the envelope. Additionally, the lenses can provide additional light control via refraction.

It is an advantage of this invention to provide an environmentally safe reflector-based luminaire which illuminates evenly and gives a natural lighting effect.

It is a further advantage of this invention to provide an illumination device such that the number of fixtures are minimized for any given situation and that the superior efficiency of high lumen package lamps are utilized.

These and other advantages will be appreciated with reference to the detailed description of the invention as follows.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

The invention will now be described with regard to its particularized elements and functional characteristics as exemplified by certain preferred and exemplary embodiments. It will be understood that these embodiments may be combined or modified slightly to define a preferred embodiment depending on the particular application to which the invention is applied. It will be further understood that what is preferred for one application may not be preferred for another application and the invention is to be all inclusive of the described detail regardless of whether one application would prefer certain features as opposed to another. The best method of carrying out this invention will depend upon the particular circumstances to which the invention is applied.

Figure 1:
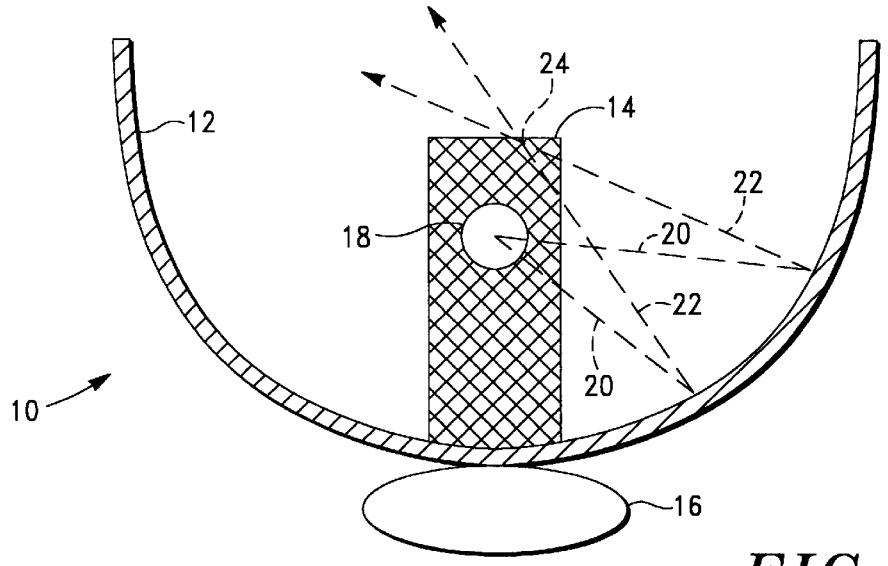
FIG.–1 (PRIOR ART)
FIG. 1 is an example of a prior art sulfur lighting fixture.

With particular respect to FIG. 1, there is shown a prior art example of a sulfur reflector lamp having a single parabolic-like reflector. The lamp is generally indicated by the numeral 10 and is a general example of those lamps in the prior art which use an elemental fill such as sulfur or selenium, as described in Dolan et al., U.S. Pat. No. 5,404,076, the disclosure which is specifically incorporated herein by reference.

As noted in Dolan et al. a mercury lamp could be used as fill. However, because of environmental concerns the fill is usually sulfur or selenium, or other environmentally safe material. Such material, while environmentally safe, also serves as an acceptable fill in a reasonably efficient manner necessary for illumination.

The prior art device includes a single parabolic-like reflector 12, a microwave screen 14, a microwave source 16, a fill of elemental material 18, such as sulfur or selenium. The fill 18 is held in place by an appropriate structure and then provides illumination through excitation by activation of the microwave source 16. The microwave source excites the fill 18 by bombarding the fill with microwave radiation. The microwave radiation is reflected and retained within the microwave screen 14. The microwave screen 14 is typically composed of a mesh material which allows most of the light to be transmitted, but which contains microwave energy, and causes it to be reflected and, in some cases, directed back toward the fill source.

As shown in FIG. 1, the path of incidence 20 causes the light rays generated by the fill 18 to be reflected from the parabolic reflector 12. The angle of incidence causes the angle of reflection and the reflected path 22 to intersect the microwave screen exterior 24. The light rays being so reflected and intersecting the microwave screen exterior 24 are attenuated, both absorbed and scattered. The absorbed rays, primarily, will decrease the system efficiency so that approximately 40 to 50 percent or more of those light rays are not available for illumination. This dramatic decrease in efficiency is typical of such a known lamp structure.

In a effort to improve the fixture, the applicants herein have designed the present invention which accordingly works generally on the principle of reflected lighting, as set forth in the description of the fixture described with respect to FIG. 1. However, the fixture efficiency of the instant invention is between 80 and 95 R percent. This increased efficiency allows fewer fixtures over a greater distance to be used while providing the required even and effective lighting. Thus, fewer fixtures will be used and there will be considerable savings both financially and spatially.

Figure 2:
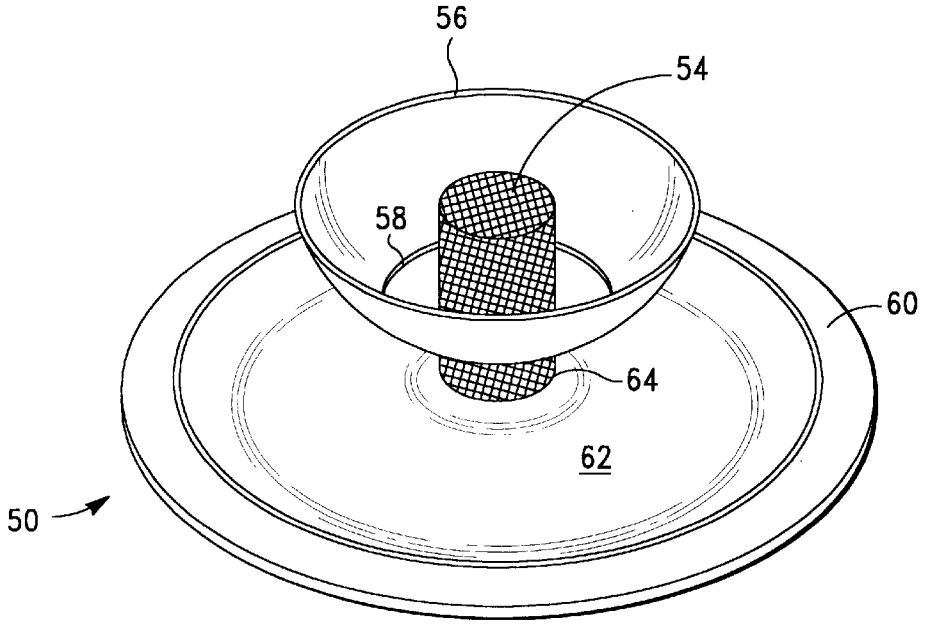
FIG. 2 is a perspective view of an exemplary embodiment of the non-contiguous bi-phase reflector system for a lighting fixture in accordance with this invention.

As particularly described with respect to FIG. 2, there in shown the first exemplary embodiment of the invention denoted generally by the numeral 50. The first exemplary embodiment 50 of the reflector system in accordance with this invention includes a light source element 52 within the interior of an envelope 54. The light source 52 is surrounded by the envelope 54. The reflector-based fixture 50 additionally includes a first reflector member 56 being designed and shaped so that the reflected rays intersect with the envelope only minimally or not at all. In particular, the first reflector 56 is sized and shaped so that reflected light rays are directed toward the center line of the fixture 50. Despite the fact that the reflected light rays are so directed, they are more particularly so directed that such reflected rays do not intersect the envelope 54. The first reflector member 56 has an open center bottom 58 and generally surrounds the light source 52 and the envelope 54.

The reflector-based fixture 50 includes a second reflector 60 which is non-contiguous with the first reflector member 56, as clearly shown in FIGS. 2 through 5. The second reflector 60 is curved at a different angle then the first reflector 56 and has a different phase of reflection. As will be more fully appreciated with respect to the description of FIG. 5, the angle of incidence and reflection are very different for the second reflector 60 than the first reflector 56. However, it will be appreciated that with respect again to the description of FIG. 5 that the second reflector 60 also has angles of incidence and reflection so that the reflected rays do not cross the microwave screen, but rather diverge from the centerline of the fixture 50 and envelope 54. In particular, the second reflector 60 is sized and shaped to diverge reflected rays away from the center line axis of the fixture.

The second reflector has a bottom portion 62, which has an opening 64 through which the light source 52 and an envelope 54 are inserted. As will also be appreciated from the illustration in FIG. 2, the bottom end of the light source 52 and the bottom 62 of the second reflector 60 generally lie in the same plane. The bottom 58 of the first reflector 56 lies in a plane spaced above the bottom plane of the second reflector 60.

Figure 3:
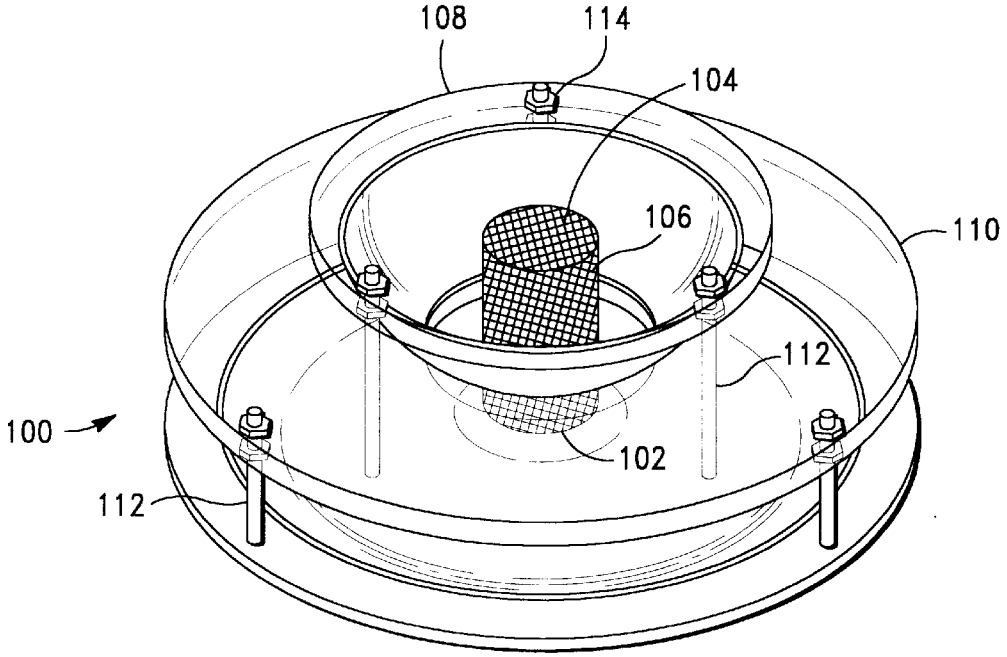
FIG. 3 is a perspective view of another exemplary embodiment of the non-contiguous bi-phase reflector system for a lighting fixture in accordance with this invention.

With particular reference to FIG. 3, there in shown another embodiment of the reflector lamp in accordance with this invention. In FIG. 3, there is shown an electrodeless reflecting lamp 100, having an electrodeless light source 102, an envelope 104 defining a microwave screen 106. Additionally, the first reflector 56 includes a glass lens 108 and the second reflector includes a glass lens 110. Additionally, the electrodeless reflector lamp 100 includes a frame defined by a series of rod members 112 and bolts 114. The reflector 56 and second reflector 60 are held together with the rods 112 and bolts 114 in the manner substantially shown in FIG. 3.

Figure 4:
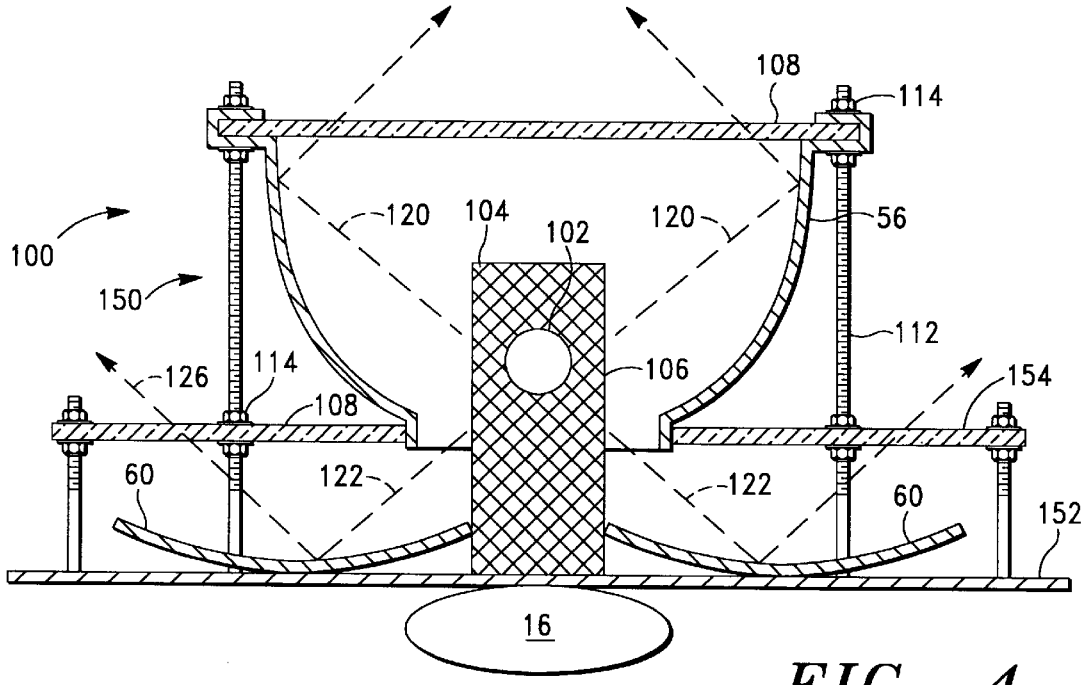
FIG. 4 is a cross sectional view of the non-contiguous bi-phase reflector system for a lighting fixture of FIG. 3 in accordance with this invention.

With particular respect to FIG. 4., there is shown a cross section of the embodiment of the reflector lamp of FIG. 3, generally indicated by the numeral 100. Each of the reflectors, 56 and 60, respectively, has a concave shape. However, the reflected light rays from the first reflector 56 converge toward the centerline of the envelope 54 and generally fixture 50 to provide illumination to the center of the lighted surface without striking the envelope 54, while the second reflector 60 has a different curvature than the first reflector 56 and directs reflected rays so that they diverge from the centerline of the envelope 54 to provide illumination to the edge regions of the lighted surface. In other words, the first concave reflector 56 has a different phase than the second concave reflector 60. It will also be appreciated that the first reflector 56 is non-contiguous with the second reflector 60. Thus, the reflector lamp according to the invention described herein is a non-contiguous bi-phase reflector lamp.

As described earlier, a microwave source 16 excites the fill or light source 102 within the envelope 104. Upon sufficient excitation of the fill material, in this case fill material is chosen from the group of sulfur, selenium, or phosphorus. It will be appreciated that the primary fill should be selected from a group consisting of an elemental material. As noted earlier mercury is environmentally unsound and is not recommended for use although in terms of illumination, it would work almost as well. Upon sufficient excitation of the fill material, light is generated and emitted through the semi-transmissive microwave screen 106. Incidence rays follow lines 120 and 122, for example. As the incident rays 120 strike the first reflector 56, an angle of reflection is created whereby light is reflected through the glass lens 108 without crossing the exterior of the microwave screen 106.

Additionally, reflected rays 126 are created which likewise are reflected by second reflector 60. As illustrated the angle of reflection is created, such that reflected rays 126 are sent through the glass lens 108 without crossing the exterior of the microwave screen 106.

Also shown with particular reference to FIG. 4 is the frame generally denoted by the numeral 150. The frame 150 includes, as mentioned above, a series of rods 112 and bolts 114. Additionally, the frame includes a first base member 152 along the same plane as the bottom plane of the envelope 104 and the second reflector 60. The frame also includes a second level base member 154. The rods 112 are threaded through the second level base 154 and are secured at either end by bolts 114 both at the outer extreme of the first reflector 56 and on the first base 152. Between the top and bottom of the rod 114, the second level base 154 is secured by bolts 114.

Figure 5:
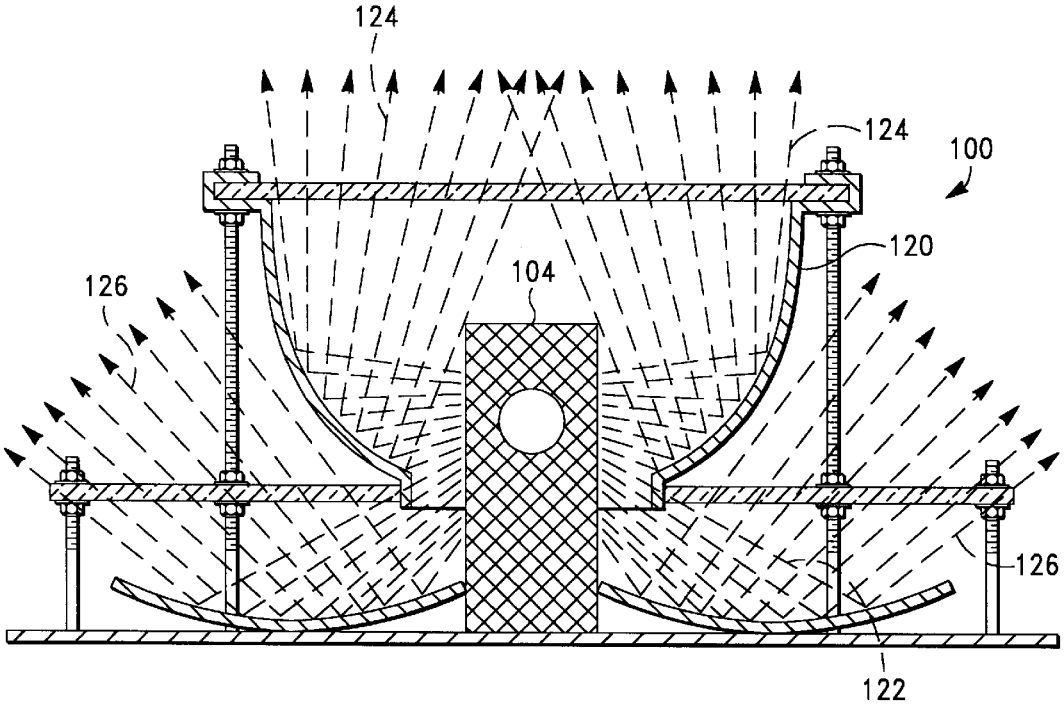
FIG. 5 is schematic representation of the light output distribution of the non-contiguous bi-phase reflector system for a lighting fixture of FIGS. 3 and 4.

With particular respect to FIG. 5, there is shown an exemplary embodiment of the electrodeless reflector lamp in accordance with this invention generally designated by numeral 100. Illustrated in FIG. 5 is a computer generated model of the rays 120, 122, 124, and 126 which represent incident and reflected rays for each of the first reflector 56 and second reflector 60. As is clearly illustrated, virtually none of the reflected rays 124, 126, which provide the illumination, are absorbed or scattered by the envelope 104 since they do not cross the exterior of the envelope.

Although not directly a part of the inventive concept, it will be appreciated that the lamp described herein as the invention, can be of various sizes and intensities with regard to its lumen output. Various lumen packages in the range of from about 2,000 to 500,000 lumens are to be expected.

It will also be appreciated that as a result of the high output and efficiency possible from the non-contiguous reflector fixture in accordance with the instant invention, various fixture designs are possible which have heretofore have not been readily useful. Such fixtures utilizing the instant reflector system may be mounted on the floor, suspended from the ceiling, or fixed to a ceiling. Such fixtures would by their design be less in number since the reflector system of the instant invention yields such light efficiently and with a widespread and relatively uniform distribution, allowing for the use of generally higher efficiency of high lumen packages. Thus, considerable economic and spatial savings would be apparent from virtually any fixture employing a reflector system in accordance with the above described invention.

It will also be appreciated that various embodiments of the invention are possible that have not been discussed particularly with respect to the illumination element. The light source exist independently of the reflector or fixture design. The applicants are not limited to the invention of a particular style of illumination device, but rather only limited to the claims as set forth below.

What is claimed is:

1. A fixture for a reflector-based illumination device, comprising:

a light source having a fill and an envelope containing the fill surrounding the light source, the fill being selected from the group consisting of: sulfur, selenium, or phosphorus;

a first reflector member surrounding the envelope;

a second reflector member, non-contiguous with the first reflector member and surrounding the light source;

the light source generating light rays creating an angle of incidence and an angle of reflection with each of the first and second reflectors and each of the reflectors being designed so that the angle of reflection, substantially causing the reflected rays not to cross the envelope surrounding the light source;

whereby, the light rays emitted from the light source illuminate without crossing the envelope and thereby illuminate without being attenuated.

2. The fixture as set forth in claim 1, wherein the fixture includes means for exciting the fill to provide illumination.

3. A fixture for a sulfur reflector-based illumination device, comprising:

a sulfur light source having a sulfur element and a microwave source for exciting the sulfur element to provide illumination from the sulfur element;

an envelope defining a microwave screen;

the microwave screen covering the sulfur element and having an interior and exterior, the interior designed to reflect microwave radiation within the interior of the screen, the microwave screen, absorbing and scattering reflected light rays as they strike and pass through the screen;

a first reflector member surrounding the light source element;

a second reflector member, non-contiguous with the first reflector member and surrounding the light source;

the light source generating light rays creating an angle of incidence and an angle of reflection with each of the first and second reflectors and each of the reflectors being designed so that the angle of reflection, substantially causing the reflected rays not to cross the envelope surrounding the light source;

whereby, the light rays emitted from the light source illuminate without crossing the envelope and thereby illuminate without being attenuated.

4. The fixture as set forth in claim 3, wherein the envelope is made of semi-transparent material to visible light.

5. The fixture as set forth in claim 3, wherein the fixture includes a glass surface and wherein the reflected rays pass through the glass surface for illumination.

6. The fixture as set forth in claim 5, wherein the glass surface defines a circular pane of microwave blocking glass.

7. The fixture as set forth in claim 5, wherein the glass surface is shaped in the form resembling a donut.

8. The fixture as set forth in claim 3, wherein the microwave screen comprises a cylindrical wire mesh structure.

9. The fixture as set forth in claim 3, wherein the light source, microwave source, and each of the reflectors are mounted on a frame.

10. The fixture as set forth in claim 9, wherein the frame is mounted on the floor.

11. The fixture as set forth in claim 9, wherein the frame is suspended from the ceiling.

12. The fixture as set forth in claim 9, wherein the frame is mounted on the ceiling.

* * * * *